United States Patent [19]

Spektor et al.

[11] Patent Number: 4,794,224

[45] Date of Patent: Dec. 27, 1988

[54] DRY FILM DEVELOPER FOR AN APERTURE CARD PRINTER

[75] Inventors: Semyon Spektor, San Francisco; Michael Veprinsky; Michael H. Ranger, both of San Jose, all of Calif.

[73] Assignee: NCR Corporation, Dayton, Ohio

[21] Appl. No.: 36,517

[22] Filed: Apr. 9, 1987

[51] Int. Cl.[4] ..... H05B 3/20

[52] U.S. Cl. ..... 219/216; 100/292; 219/388; 355/3 FU

[58] Field of Search ..... 219/216, 388, 343; 355/3 FU, 9, 14 FU; 156/583.1, 583.7, 583.91; 53/559; 493/322, 320; 425/347, 349, 423, DIG. 13; 100/93 P, 295, 266, 268, 260, 291, 292

[56] References Cited

U.S. PATENT DOCUMENTS

| | | | |
|---|---|---|---|
| 2,638,964 | 5/1953 | Andina | 219/243 |
| 3,321,353 | 5/1967 | Zelnick | 156/583.1 |
| 3,570,064 | 3/1971 | DeGroot | 425/347 |
| 3,808,772 | 5/1974 | Turtschan | 53/559 |
| 3,826,896 | 7/1974 | Thompson | 219/216 |
| 3,856,460 | 12/1974 | Hynes | 219/216 |
| 4,068,448 | 1/1978 | Modeen | 53/559 |
| 4,420,923 | 12/1983 | Moser | 53/559 |
| 4,603,541 | 8/1986 | Medwed | 53/559 |

*Primary Examiner*—E. A. Goldberg
*Assistant Examiner*—Teresa J. Walberg
*Attorney, Agent, or Firm*—Wilbert Hawk, Jr.; Edward Dugas

[57] ABSTRACT

An improved dry film developer for use with a machine of the type that processes aperture cards which developer incorporates a holding mechanism for holding and stretching the aperture card while a heating block having an arcuate projecting surface is urged against the undeveloped dry film, mounted in the aperture card, to slightly stretch the film so as to insure a uniform contact of the undeveloped film with the heating block for a period of time sufficient to develop the film.

11 Claims, 3 Drawing Sheets

DRY FILM DEVELOPER FOR AN APERTURE CARD PRINTER

BACKGROUND OF THE INVENTION

The present invention is related to the field of dry film processing and more particularly to a developer which heats the film to a developing temperature as the film is stretched against an arcuate projecting heating surface.

A heat processable film has been developed wherein images recorded on the film can be developed by heating the film to its developing temperature and then cooling the film generally to room temperature. The film may be of the type manufactured by the Kodak Co. of Rochester, N.Y.

Three patents of interest for purposes of establishing the state of the art are: U.S. Pat. No. 4,009,034, entitled "Dry Film Processing" by J. N. May;

U.S. Pat. No. 4,501,487, entitled "Microfiche Recording Apparatus and Method with Stationary Film Head" by M. H. McCormick; and U.S. Pat. No. 4,613,876, entitled "Laser Recording System" by S. H. Mohr.

The #034 and #487 patents disclose a heating block having an arcuate projecting heating surface which is urged against the dry film. The #034 patent requires a complementary surfaced heating block positioned adjacent the first heating block for directing heat to the back surface of the dry films. Neither patent shows a mechanism for holding the film while it is stretched into a uniform contact with the arcuate projecting heating surface.

The #876 patent is referenced for its teaching of a recording system for automatically placing an image on the film of an aperture card.

SUMMARY OF THE INVENTION

The present invention is an improved dry film developer for use with an automatic machine of the type which records an image on a frame of dry film mounted to an aperture card, which improvement comprises; a heating block having a recessed area corresponding to the area of the dry film having an image recorded thereon and guides for guiding an aperture card such that the frame of dry film is positioned adjacent the recessed area, a heater block assembly having an arcuate projecting heating surface for generating a temperature sufficient to develop the dry film, and a holding mechanism for holding and stretching the aperture card as the arcuate projecting heating surface is urged against and stretches the dry film for a period of time sufficient to develop the film.

In view of the above discussion, the principal object of the present invention is to provide an improved dry film developer.

It is another object of the present invention to provide a dry film developer which holds the film while the film is slightly stretched against a heat source for development.

These and other objects of the present invention will become more apparent when taken in conjunction with the following description and drawings wherein like characters indicate like parts and which drawings form a part of the present disclosure.

DESCRIPTION OF THE PREFERRED EMBODIMENT

Figure 1:
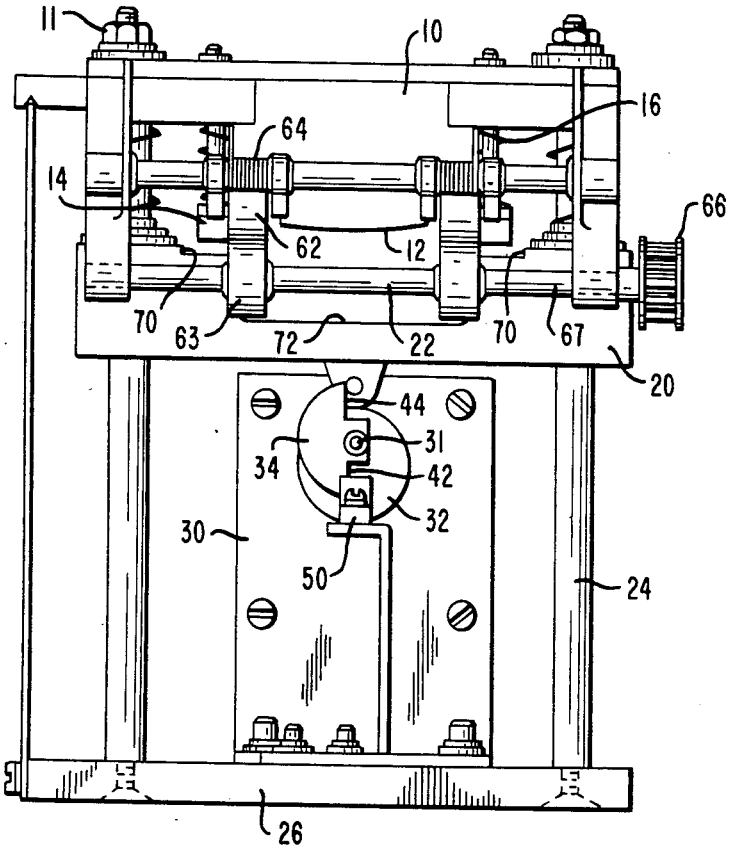
FIG. 1 is a front elevation view of the improved developer mechanism.
Figure 2:
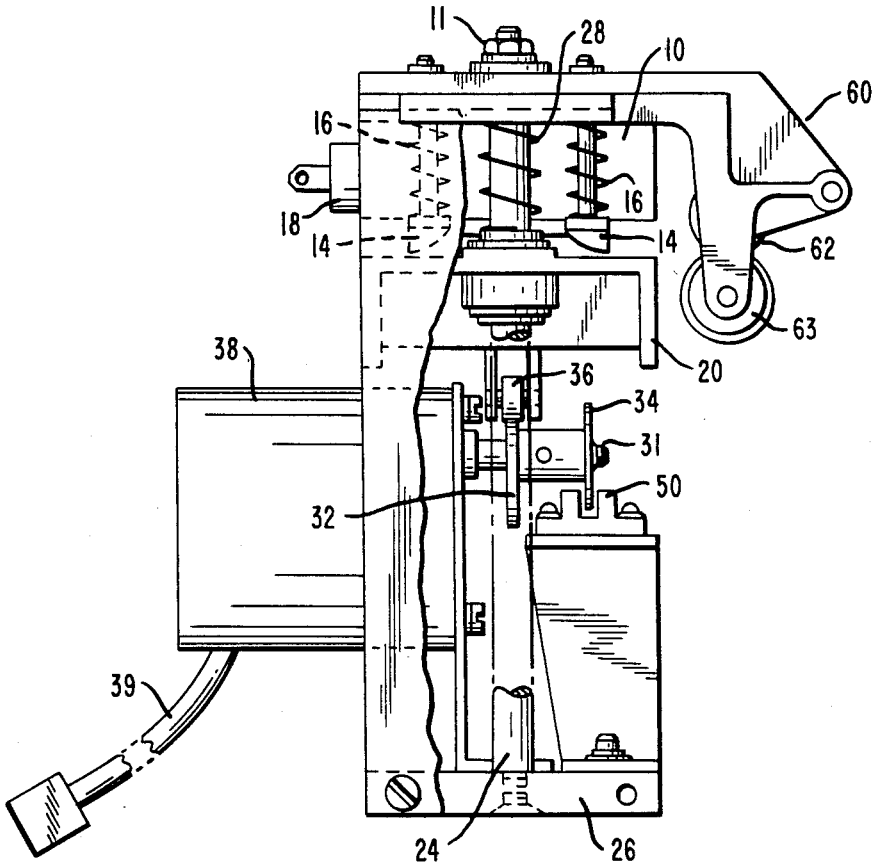
FIG. 2 is a side elevation view of the improved developer mechanism.

Referring to FIGS. 1 and 2 wherein the improved dry film developer of the present invention is shown with a base member 26 supporting two rods 24 each having threaded ends, a heater block assembly 10 is rigidly affixed to the threaded ends of the rods 24 by nuts 11. The central portion of the heater block assembly 10 houses a heater 13 (shown in FIG. 3) which is powered through a power plug 18.

Figure 3:
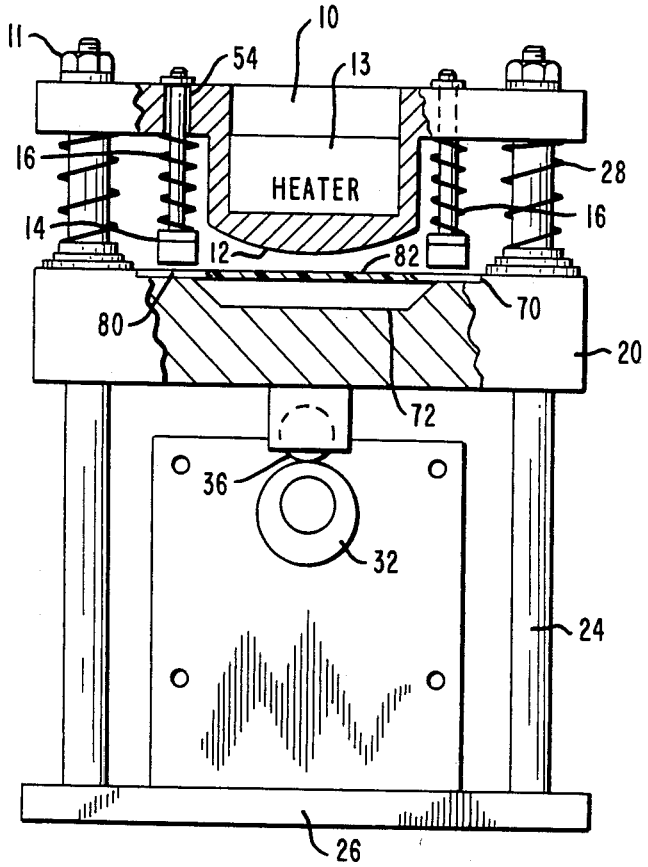
FIG. 3 is a simplified, partially cut away, front view of the developer mechanism of FIG. 1.

The heateer block assembly 10 is provided with an arcuate projecting heating surface 12. Referring momentarily to FIG. 3 which is a simplified drawing of the front of the dry film developer, four sleeve bushings 54 extend through the heater block assembly 10 on each side of the central portion.

Spring loaded fingers 16, having a gripping surface 14, are slidably mounted within the sleeve bushings 54.

A bearing block 20, having a recessed area 72, is slidably mounted on the two rods 24 with two springs 28 inserted on the rods between the heater block assembly 10 and the bearing block 20. The bearing block contains a set of guide surfaces 70 for receiving an aperture card 80 on which is mounted a frame of dry film 82 having an image recorded thereon.

The gripping surfaces 14 are positioned so as to contact the aperture card 80, on each side of the frame of dry film, when the bearing block 20 is urged toward the heater block assembly 10. The gripping surfaces 14 are triangularly shaped with the tips of the triangles positioned parallel to the arc of the arcuate surface 12. In operation, as the tips of the gripping surfaces 14 contact the aperture card 80 and are urged into further contact the tips bend outward stretching the card 80 and the film 82. The stretching provided by the gripping surfaces 14 is perpendicular to the stretching provided by the arcuate surface 12. The combined stretching insures good contact with the heated arcuate surface 12.

Referring back to FIGS. 1 and 2 various mechanisms may be used to urge the bearing block 20 into the developing position. The preferred embodiment of the invention utilizes an eccentric cam 32, contacting a roller 36 mounted to the bearing block 20, which cam is driven by a motor 38. The motor 38 receives its power through the power cord 39.

In the preferred embodiment of the invention the heater is maintained at a temperature of 260° F. and is maintained in contact with the dry film for a period of 3.5 seconds for film development. A timer (not shown) is actuated by the crescent wheel 34 along with an LED and photodetector mounted within the element 50. In the rest position the edge 42 of the crescent wheel 34 is on the left side of the LED beam. When the motor is started the beam is broken by the crescent wheel 34 until the edge 44 appears on the right side of the beam, at which time the bearing block is in its uppermost position. The bearing block remains in that position for the required development time and then is driven to its rest position awaiting the next aperture card.

A drive mechanism 60 is used to urge the aperture card into the correct position for developing. The drive mechanism 60 is comprised of two sets of spring loaded pinch rollers comprised of a first and second roller, 62 and 63, respectively loaded by springs 64. The bottom set of rollers 63 are driven by a shaft 67 which in turn is driven by a pulley 66 via a drive belt (not shown).

From the foregoing description it can be seen that the objects of the present invention have been met.

While there has been shown what is considered to be the preferred embodiment of the invention, it will be manifest that many changes and modifications may be made therein without departing from the essential spirit of the invention. It is intended, therefore, in the annexed claims, to cover all such changes and modifications that may fall within the true scope of the invention.

We claim:

1. An improved dry film developer for use with a dry process aperture card machine of the type which records an image on a frame of heat developable film mounted on the aperture card and which automatically processes the film through development, comprising:

a bearing block having a recessed area corresponding to the area of the heat developable film, said bearing block having guides thereon for guiding a frame of heat developable film over the recessed area;

a heater block for generating a temperature sufficient to develop the heat developable film, said heater block having a projecting arcuate surface;

means for mounting said heater block to said bearing block so that the arcuate surface of said heater block can be urged toward the recessed area of said bearing block; and holding means affixed to said heater block for holding the frame of heat developable film over the recessed area of said bearing block while the arcuate surface of the heater block stretches and heats the heat developable film.

2. The improved dry film developer of claim 1 wherein said holding means is comprised of:

four spring loaded plungers, one positioned at each corner of the frame of heat developable film with each plunger having a gripping surface which flexes to further stretch the heat developable film as the arcuate surface of the heater block stretches the film.

3. The improved dry film developer of claim 1, further comprising:

an eccentric cam means operatively coupled to said bearing block for urging said bearing block and said heater block into close proximity so as to stretch, heat develop, and release a frame of heat developable film for each rotation of said eccentric cam means.

4. The improved dry film developer of claim 1 wherein the projecting arcuate surface of said heater block is shaped to eliminate gaps in the stretched film area being heat developed.

5. The improved dry film developer of claim 1 wherein the temperature of the projecting arcuate surface of said heater block is approximately 260° F. and the arcuate surface is maintained in contact with the heat developable film for approximately 3.5 seconds.

6. The improved dry film developer of claim 1, further comprising:

means affixed to said heater block for urging a frame of heat developable film into alignment with the recessed area of said bearing block.

7. An improved dry film developer for use with a machine of the type that records images on a frame of dry film mounted to an aperture card, comprising:

a base member;

at least one pair of rods extending from said base member;

a heater block for generating a temperature sufficient to develop a dry film, said heater block having a projecting arcuate surface which stretches and heats the film and is mounted to said at least one pair of rods;

a bearing block having a recessed area corresponding to the size of a frame of dry film movably mounted to said at least one pair of rods; and holding means for holding a frame of dry film between said heater block and said bearing block as said blocks are urged into a development position.

8. The improved dry film developer according to claim 7 wherein said holding means is comprised of:

four spring loaded plungers, one positioned at each corner of the frame of dry film.

9. The improved dry film developer according to claims 7, further comprising:

an eccentric cam means operatively coupled to said bearing block for urging said bearing block into close proximity to said heater block so as to stretch, heat develop, and release a frame of dry film for each rotation of said eccentric cam means.

10. The improved dry film developer according to claim 7 wherein the temperature of the projecting arcuate surface of said heater block is approximately 260° F. and the arcuate surface is maintained in contact with the frame of dry film for approximately 3.5 seconds.

11. The improved dry film developer according to claim 8 wherein said holding means is further comprised of:

four flexible members affixed to the ends of said four spring loaded plungers for stretching the frame of dry film as said plungers are urged toward the dry film.

* * * * *